US007748673B2

(12) United States Patent
Barrese

(10) Patent No.: US 7,748,673 B2
(45) Date of Patent: Jul. 6, 2010

(54) HOOK FOR SUPPORTING SHOWER CURTAIN AND SHOWER CURTAIN LINER AND METHOD FOR FABRICATING SAME

(75) Inventor: Charles Barrese, Huntington, NY (US)

(73) Assignee: Ex-Cell Home Fashions Inc., New York, NY (US)

( * ) Notice: Subject to any disclaimer, the term of this patent is extended or adjusted under 35 U.S.C. 154(b) by 885 days.

(21) Appl. No.: 10/928,844

(22) Filed: Aug. 27, 2004

(65) Prior Publication Data

US 2006/0042002 A1 Mar. 2, 2006

(51) Int. Cl.
*A47B 96/06* (2006.01)

(52) U.S. Cl. ..... 248/215; 248/340; 24/716; D8/367; D8/372

(58) Field of Classification Search ..... 248/215, 248/303, 340; 140/80; D8/367, 370, 372; 24/598.6, 698.3, 370, 716; 160/348, 404
See application file for complete search history.

(56) References Cited

U.S. PATENT DOCUMENTS 834,188 A * 10/1906 Carr ..... 24/716
1,143,100 A * 6/1915 Brewington ..... 24/360
1,294,617 A * 2/1919 Cartisser ..... 24/370 X
1,333,692 A * 3/1920 Wester ..... 248/215
2,553,272 A * 5/1951 Perlmutter ..... 160/348 X
2,758,645 A * 8/1956 Sherman ..... 160/348
4,979,712 A * 12/1990 Rios ..... 248/215
5,018,694 A * 5/1991 Olson ..... 248/340 X
D489,249 S * 5/2004 Moore ..... D8/367

* cited by examiner

*Primary Examiner*—Robert M Fetsuga
(74) *Attorney, Agent, or Firm*—Alston & Bird LLP

(57) ABSTRACT

A hook is provided for simultaneously supporting a shower curtain and a shower curtain liner in side by side spaced, parallel relation on a shower curtain rod. The shower curtain and the shower curtain liner each have an opening therein proximate the top edge thereof. The hook includes a portion for engaging the rod. First and second spaced support portions, each of which is connected to the rod engaging portion, are provided. Each of the support portions includes a generally "U" shaped portion defined in part by an upstanding member. The upstanding member of the first support portion is adapted to be received through the opening in the shower curtain to retain the shower curtain. The upstanding member of the second support portion is adapted to be received through the opening in the shower curtain liner to retain the shower curtain liner. The hook is fabricated from a single continuous wire section by making a series of bends therein.

10 Claims, 4 Drawing Sheets

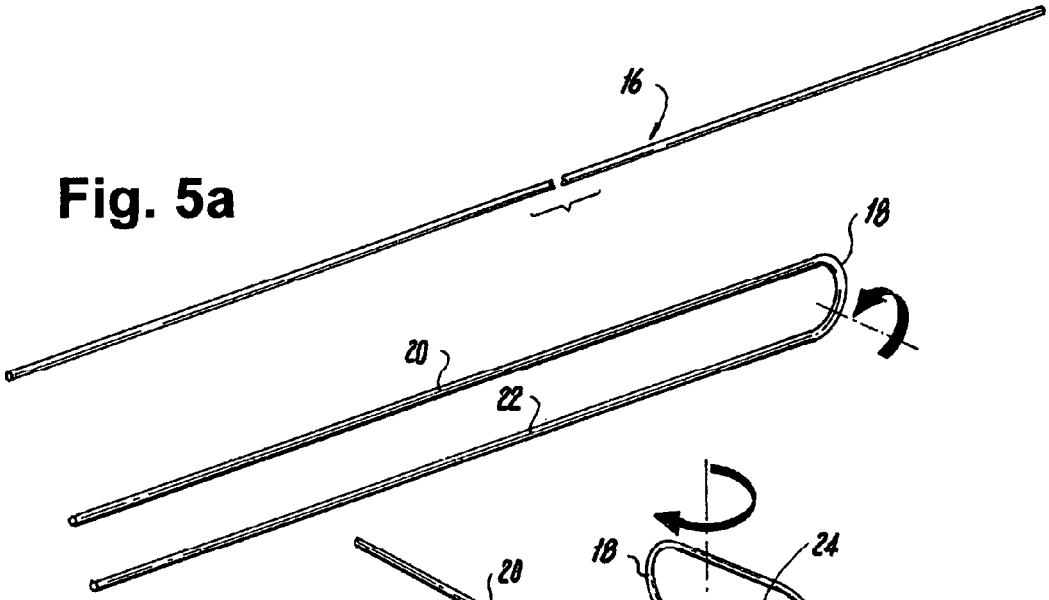
Fig. 5a
Fig. 5b
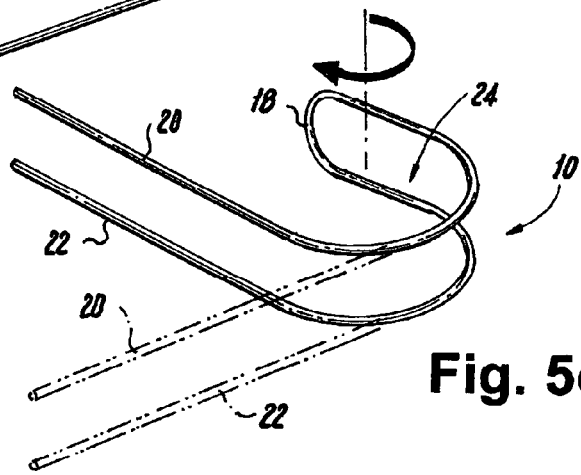
Fig. 5c
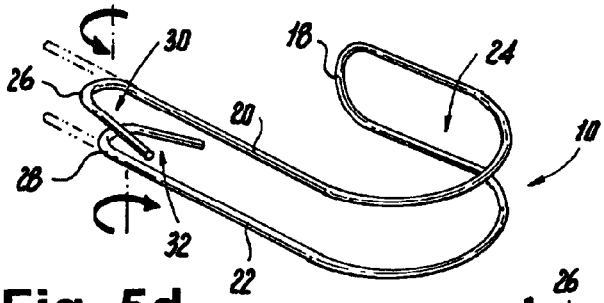
Fig. 5d
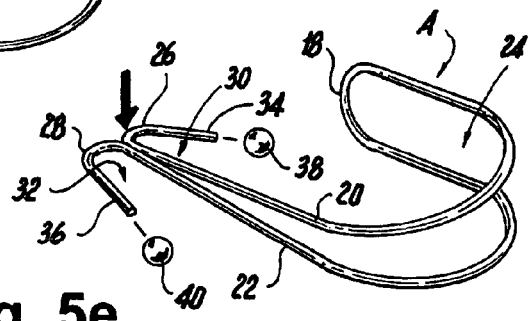
Fig. 5e

HOOK FOR SUPPORTING SHOWER CURTAIN AND SHOWER CURTAIN LINER AND METHOD FOR FABRICATING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to hooks for supporting shower curtains and shower curtain liners, and more particularly to a hook for simultaneously supporting a shower curtain and a shower curtain liner in spaced parallel relation on a rod and to a method of fabricating such a hook from a single continuous wire section.

2. Description of Prior Art Including Information Disclosed Under 37 CFR 1.97 and 1.98

It is known in the art to use two separate sets of hooks to support a shower curtain and a shower curtain liner on a horizontal rod mounted in a shower enclosure, over a bathtub or the like. However, utilizing two sets of hooks for that purpose requires two separate horizontal rods, one for each set of hooks or, more commonly, that both sets of hooks be supported on the same rod, leading to crowding and interference between the hooks as the curtain and liner are drawn along the rod. Moreover, utilizing two sets of hooks is wasteful and expensive. It is also more time consuming to install the curtain and liner when separate sets of hooks are employed.

It is therefore desirable to utilize a single set of hooks suspended from a single horizontal bar to support both the shower curtain and the shower curtain liner simultaneously.

Further, many hooks of this type are made of molded plastic or of rust-resistant metal parts that are attached to each other. While metal is a superior material, fabricating the metal parts separately and then assembling them to form the hook involves extra expense. Fabricating the hook from a single continuous wire section is more efficient and less expensive.

It is, therefore, a prime object of the present invention to provide a hook for simultaneously supporting a shower curtain and a shower curtain liner.

It is another object of the present invention to provide a method for fabrication a hook for simultaneously supporting a shower curtain and a shower curtain liner from a single continuous wire section.

BRIEF SUMMARY OF THE INVENTION

In accordance with one aspect of the present invention, a hook is provided for simultaneously supporting a shower curtain and a shower curtain liner on a rod. The shower curtain and the shower curtain liner each have an opening therein proximate the top edge thereof. The hook includes means for engaging the rod. It also includes first and second spaced support means. Each of the support means is connected to the rod engaging means and includes a generally "U" shaped support portion defined in part by an upstanding member. The upstanding member of the first support portion is adapted to be received through the opening in the shower curtain such that the shower curtain is retained on the "U" shaped portion of the first support means. The upstanding member of the second support means is adapted to be received through the opening in the shower curtain liner such that the shower curtain liner is retained on the "U" shaped portion of the second support means. In this way, the shower curtain and the shower curtain liner are supported in side by side spaced relation from the hook.

The rod engaging means includes a generally "U" shaped rod engaging member bent to form a recess into which the rod is received. The "U" shaped rod engaging member has first and second ends. The first support means is attached to the first end of the "U" shaped rod engaging member. The second support means is attached to the second end of the "U" shaped rod engaging member.

The hook includes a spherical member attached to the upstanding member of one of the support means. Alternatively, the hook may have first and second spherical members, each attached to the upstanding member of a different one of the support means, respectively.

Preferably, the hook, including the rod engaging means and the first and second support means, is formed of a single continuous wire section.

In accordance with another aspect of the present invention, a method is provided for fabricating a hook for simultaneously supporting a shower curtain and a shower curtain liner on a rod from a single continuous wire section. The method includes the steps of bending the wire section to form a first "U" shaped bend in the wire section, proximate the middle thereof. Each of the sections of the wire extending from the first bend is bent so as to form spaced, parallel second "U" shaped bends therein. Each of the second bends defines a recess large enough to receive the rod. The ends of each of the sections are then bent in substantially opposite directions to form first and second "U" shaped recesses respectively adapted to retain the shower curtain and the shower curtain liner.

The method also includes the steps of forming a spherical member and attaching the spherical member to the tip of one of the section ends.

The step of bending the ends to form the support means includes the step of bending the ends of the sections in substantially the same plane.

The step of bending the wire section to form the first bend includes the step of bending the wire section to form the first bend in a plane substantially perpendicular to the plane of the bent ends.

The step of bending the sections extending from the first bend includes the step of bending the sections in planes substantially perpendicular to the plane of the first bend.

BRIEF DESCRIPTION OF THE SEVERAL VIEWS OF DRAWINGS

To those, and to such other objects as may hereinafter appear, the present invention relates to a hook for supporting a shower curtain and a shower curtain liner and to a method for fabricating same, as set forth in detain in the following specification and recited in the annexed claims, taken together with accompanying drawings, wherein like numerals refer to like parts, and in which:

FIGS. 5*a* through 5*e* are sequential views illustrating the fabrication of the hook from a single continuous wire section.

DETAILED DESCRIPTION OF THE INVENTION

Figure 1:
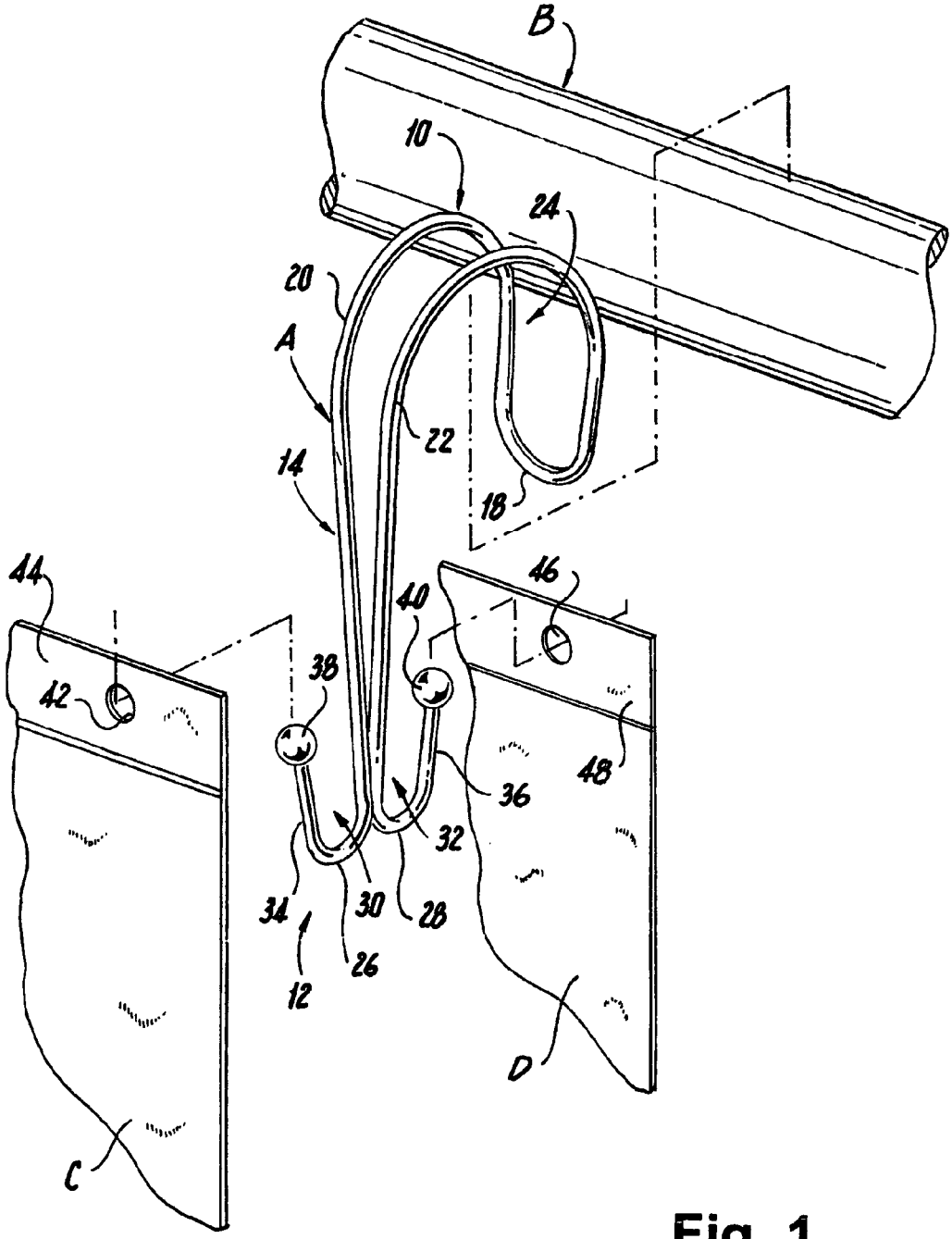
FIG. 1 is a perspective view of a first preferred embodiment of the hook of the present invention showing how the hook engages the shower curtain rod and supports the shower curtain and the shower curtain liner in side by side relation.
Figure 2:
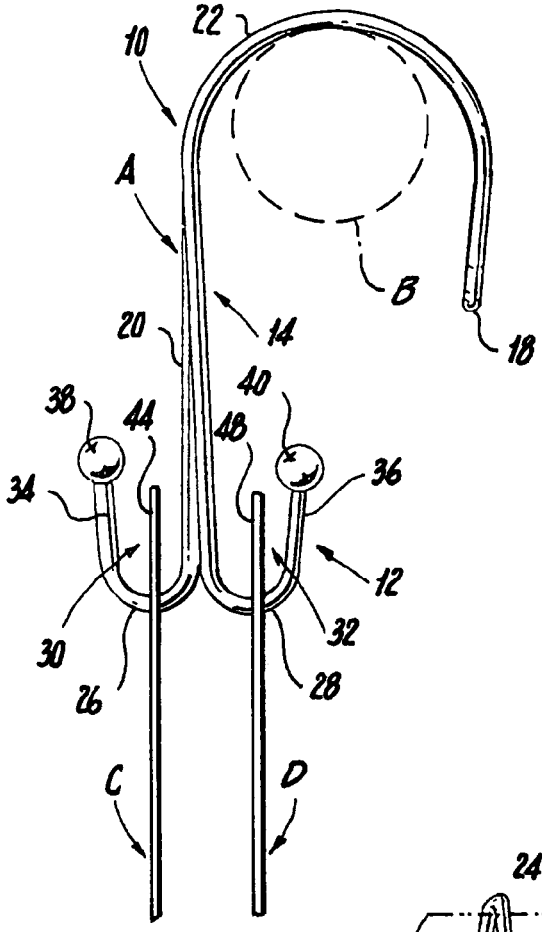
FIG. 2 is a side elevation view of the hook of FIG. 1.
Figure 3:
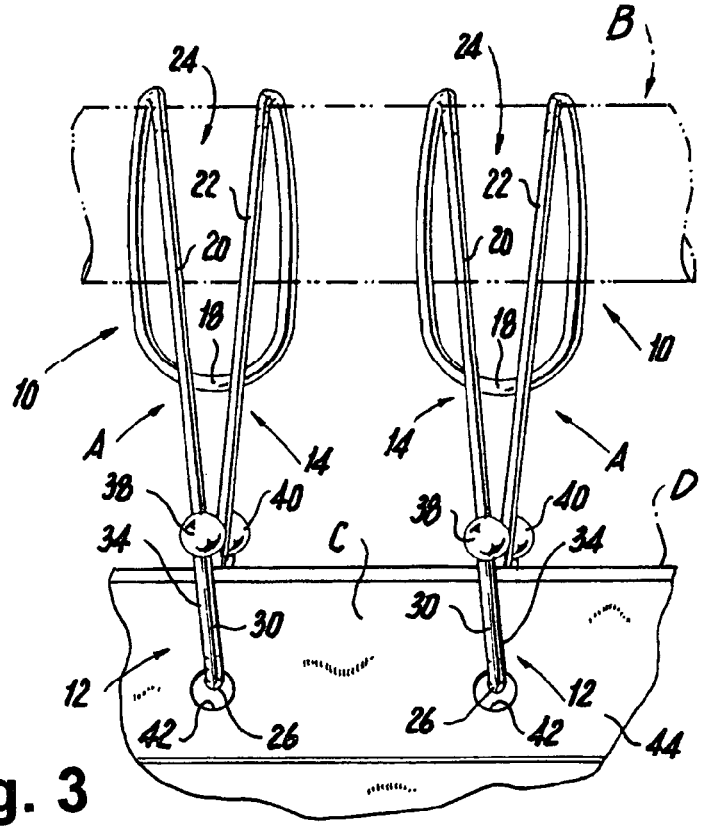
FIG. 3 is a front elevation view of two of the hooks of FIG. 1 mounted on a rod.

FIGS. 1 through 3 illustrate the structure of the first preferred embodiment of the present invention. The hook, generally designated A, is adapted to engage a horizontal shower curtain rod, generally designated B, of conventional design in order to simultaneously support a fabric or plastic shower curtain, generally designated C, and a plastic shower curtain liner, generally designated D, in side by side, substantially parallel, spaced relation within a shower enclosure or the like.

Hook A includes a shower curtain rod engaging portion 10, a support portion 12 and a portion 14 connecting the support portion 12 with the rod engaging portion 10. As seen in FIGS. 5*a* through 5*e*, hook A is formed from a single continuous wire section 16 in which a first bent 18 is made proximate the mid section of the wire section to form an initial "U" shape, with sections 20, 22 extending from bend 18 in generally parallel, spaced relation.

Next, sections 20 and 22 are each bent into a plane perpendicular to the plane of bend 18 to define a recess 24 large enough to engage the rod B. In that manner, the rod engaging portion 10 of the hook is formed, as seen in FIG. 5*c*.

The support portion 12 of the hook is fabricated by forming oppositely directed bends 26 and 28 proximate the ends of sections 20 and 22, respectively, resulting in "U" shaped portions 30 and 32. Each of the "U" shaped portions 30, 32 includes an upstanding outer member 34 and 36, respectively, as seen in FIG. 5*d*. Portions 30 and 32 are bent toward each other such that they lie almost in the same plane. That plane is substantially perpendicular to the plane of the first bend 18.

The final fabrication step is to form spherical members 38 and 40. Those members are then attached by any conventional means to the tips of the upstanding members 34, 36 of "U" shaped portions 30 and 32, respectively.

As will now be appreciated, the present invention relates to a hook A for simultaneously supporting a shower curtain C and a shower curtain liner D on a rod B. The shower curtain C and the shower curtain liner D each have an opening 42, 46 therein proximate the top edge thereof. Hook A includes means 10 for engaging rod B, as well as a first support means 30 and a second support means 32 spaced from each other. Each of the support means 30, 32 includes means 26, 28, respectively, for engaging the opening in a different one of the shower curtain and the shower curtain liner such that the shower curtain and the shower curtain liner are supported on the hook in side by side spaced relation. The support means 30, 32 are situated substantially within a plane. The rod engaging means 10 includes first and second members 20, 22, each having an end portion and a generally "U" shaped member 18 connecting the end portions of the first and second members 20, 22. The plane of support means 30, 32 intersects the "U" shaped member 18.

The "U" shaped member 18 is situated substantially in a plane. The plane of support means 30, 32 intersects the plane of "U" shaped member 18. Preferably, the plane of the support means 30, 32 is situated substantially perpendicular to the plane of "U" shaped member 18.

Figure 4:
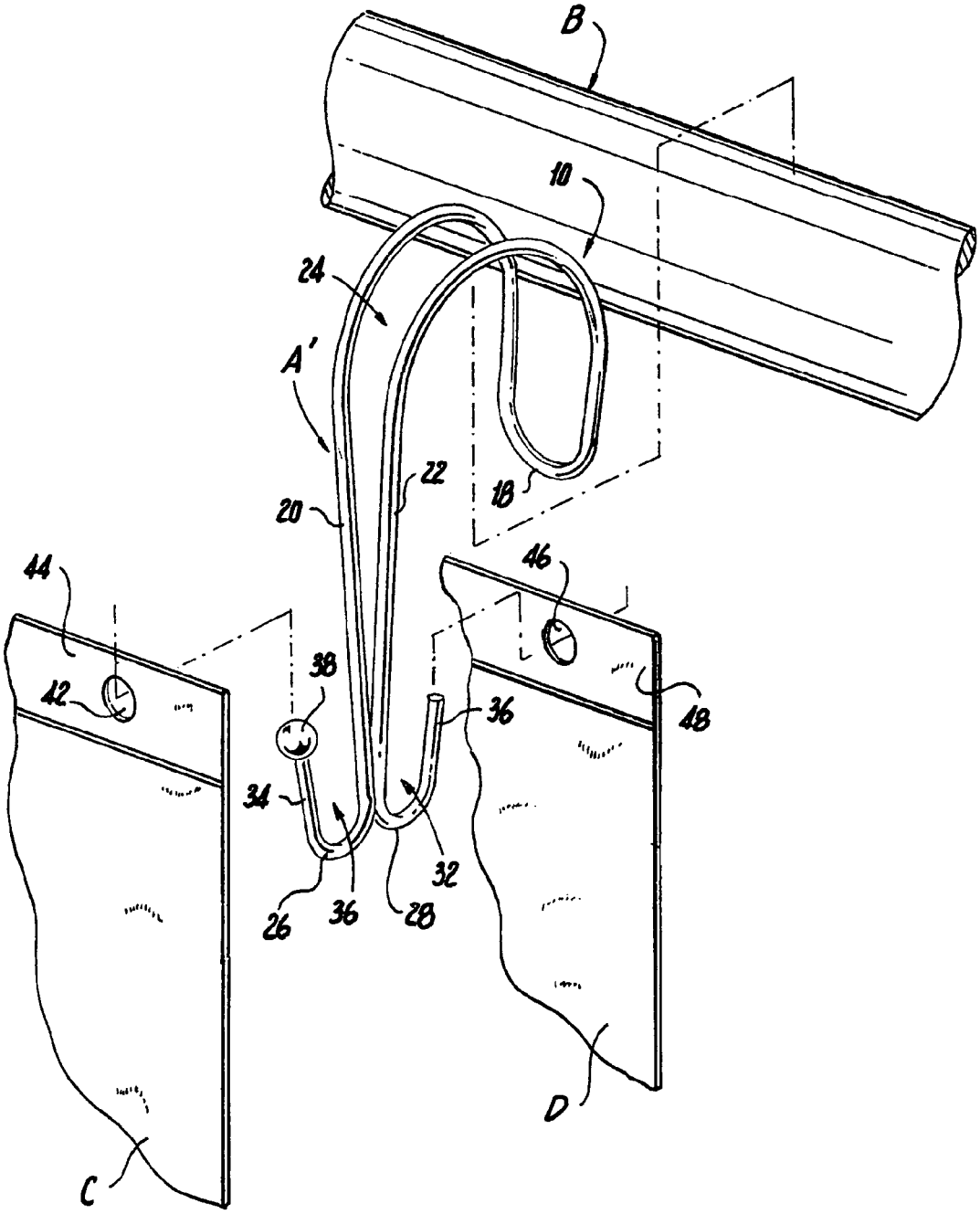
FIG. 4 is a perspective view of a second preferred embodiment of the hook of the present invention showing how the hook engages the shower curtain rod and supports the shower curtain and the shower curtain liner in side by side relation.

FIG. 4 illustrates the second preferred embodiment of the hook of the present invention, generally designated A'. Hook A' is identical to hook A, except that hook A' has only a single spherical member 38, same being attached to the tip of upstanding member 34 of the shower curtain "U" shaped support portion 30. The tip if the upstanding member 36 of the "U" shaped shower curtain liner support portion 32 has no spherical member mounted thereon in this preferred embodiment.

In use, a plurality of hooks in accordance with the present invention are suspended at spaced intervals along shower curtain rod B. Shower curtain C has a plurality of openings 42 spaced along its top edge 44, which is usually reinforced so that it can hold the weight of the shower curtain, even when wet. Spherical member 38 of the hook is sized such that it can fit through opening 42 in the shower curtain. The spherical members 38 of each of the hooks is inserted through each of the openings 42 in the curtain such that the upstanding member 34 of each hook is received in each opening along the shower curtain top and the top of the curtain is retained at the bend 26 of the "U" shaped support portion 30 of each hook.

Similarly, shower curtain liner D is provided with a series of spaced openings 46 in its reinforced top portion 48. The spherical member 40, if present, is sized to fit through the opening 46 in the shower curtain liner. The member 40 and the upstanding member 36 of the "U" shaped support portion 32 of each hook are received through the openings 46 in top portion 48 of the shower curtain liner. In this way, the top portion 48 of the shower curtain liner is retained at the bend 28 of the "U" shaped support portions 32 of each of the hooks.

It will now be appreciated that the present invention relates to a hook for simultaneously supporting a shower curtain and a shower curtain liner in side to side spaced, parallel relation from a curtain rod. The hook is fabricated from a single continuous wire section in a simple and inexpensive manner.

While only a limited number of preferred embodiments of the present invention have been disclosed for purposes of illustration, it is obvious that many variations and modifications could be made thereto. It is intended to cover all of those variations and modifications that fall within the scope of the present invention as defined by the following claims:

I claim:

1. A hook for simultaneously supporting a shower curtain and a shower curtain liner on a rod, each of the shower curtain and the shower curtain liner having an opening therein proximate the top edge thereof, said hook comprising:

a single continuous wire having a first bend proximate a mid section of the single continuous wire and first and second sections extending from the first bend in a generally parallel, spaced relationship to second and third bends of the single continuous wire, wherein each of the second and third bends are generally perpendicular to the first bend and collectively the first, second, and third bends define a recess to engage the rod, wherein the first section extends from the second bend to a fourth bend of the single continuous wire and the second section extends from the third bend to a fifth bend of the single continuous wire, wherein the fourth and fifth bends are directed generally opposite from and away from one another, and wherein the first section extends from the fourth bend to an end of the first section defining a first upstanding outer member for engaging the opening of the shower curtain and the second section extends from the fifth bend to an end of the section defining a second upstanding outer member for engaging the opening of the shower curtain liner and wherein the first and second sections extend toward one another from the second and third bends to the fourth and fifth bends such that a distance between the first and second sections at the second and third bends generally decreases as the first and second sections extend from the second and third bends to the fourth and fifth bends.

2. The hook according to claim 1 further comprising a first spherical member attached to the end of the first section.

3. The hook according to claim 2 further comprising a second spherical member attached to the end of the second section.

4. The hook according to claim 1, wherein at least a portion of the first section and a portion of the second section contact one another proximate the fourth and fifth bends.

5. The hook according to claim 1, wherein the first bend generally defines a U-shape.

6. The hook according to claim 5, wherein each of the second and third bends generally defines a U-shape.

7. The hook according to claim 6, wherein each of the fourth and fifth bends generally defines a U-shape.

8. The hook according to claim 1, wherein each of the fourth and fifth bends is generally parallel to each of the second and third bends.

9. The hook according to claim 1, wherein each of the fourth and fifth bends is generally perpendicular to the first bend.

10. The hook according to claim 1, wherein the fourth and fifth bends are generally co-planar.

* * * * *